United States Patent [19]

Keilmann et al.

[11] Patent Number: 4,658,752

[45] Date of Patent: Apr. 21, 1987

[54] METHOD AND APPARATUS FOR DRAWING A NEEDLE THREAD THROUGH A WORKPIECE

[75] Inventors: Werner Keilmann, Lorsch; Hans Scholl, Oerlinghausen-Lipperreihe; Günter Raupach, Bielefeld, all of Fed. Rep. of Germany

[73] Assignee: Kochs Adler, AG, Fed. Rep. of Germany

[21] Appl. No.: 850,250

[22] Filed: Apr. 10, 1986

[30] Foreign Application Priority Data

Apr. 16, 1985 [DE] Fed. Rep. of Germany ..... 3513506
Feb. 12, 1986 [DE] Fed. Rep. of Germany ..... 3604299

[51] Int. Cl.[4] ..... D05B 47/04; D05B 49/00

[52] U.S. Cl. ..... 112/262.1; 112/253; 112/255

[58] Field of Search ..... 112/262.1, 253, 286, 112/255, 254, 235, 320; 242/149, 150 R, 147 A; 188/65.1, 65.3

[56] References Cited

U.S. PATENT DOCUMENTS

| | | | |
|---|---|---|---|
| 2,885,985 | 5/1959 | Kells | 112/253 |
| 2,988,031 | 6/1961 | Reid | 112/253 |
| 3,312,185 | 4/1967 | Chezaud et al. | 112/255 X |
| 3,996,866 | 12/1976 | Bianchi | 112/254 |
| 4,215,641 | 8/1980 | Dobrjanskyj et al. | 112/255 X |
| 4,364,319 | 12/1982 | Niehaus et al. | 112/253 X |
| 4,508,043 | 4/1985 | Vollmar | 112/235 |

FOREIGN PATENT DOCUMENTS

| | | |
|---|---|---|
| 276162 | 8/1913 | Fed. Rep. of Germany . |
| 1141165 | 6/1963 | Fed. Rep. of Germany . |
| 6603307 | 9/1967 | Fed. Rep. of Germany . |
| 2815297 | 1/1983 | Fed. Rep. of Germany . |
| 2526694 | 1/1984 | Fed. Rep. of Germany . |

*Primary Examiner*—Werner H. Schroeder
*Assistant Examiner*—Andrew M. Falik
*Attorney, Agent, or Firm*—Laff, Whitesel, Conte & Saret

[57] ABSTRACT

A method for drawing the free end of the needle thread from the upper workpiece surface to the lower workpiece surface when sewing the first stitch of a seam to be produced by a sewing machine having a reciprocable needle, which carries the needle thread drawn from a spool by means of a thread lever, at least one presser foot lowerable upon and liftable from the workpiece, and a rotatingly drivable hook, the point of which seizes and withdraws the needle thread for the stitch formation. In order to safely and automatically prevent the thread end of the needle thread from being clamped between the presser foot and the workpiece, the needle thread is held between the needle and the thread take-up lever while the needle thread loop is withdrawn by the hook beak, so that the thread end is drawn through the workpiece by the hook beak.

12 Claims, 9 Drawing Figures

Fig. 1
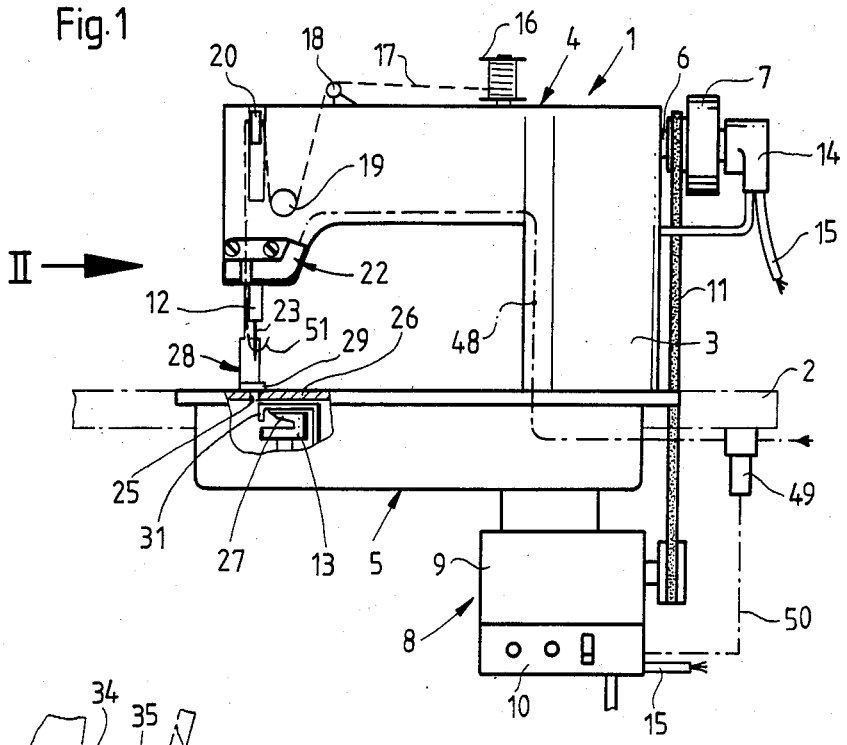
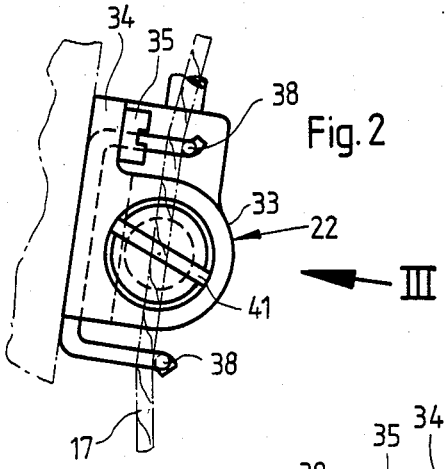
Fig. 2
Fig. 3
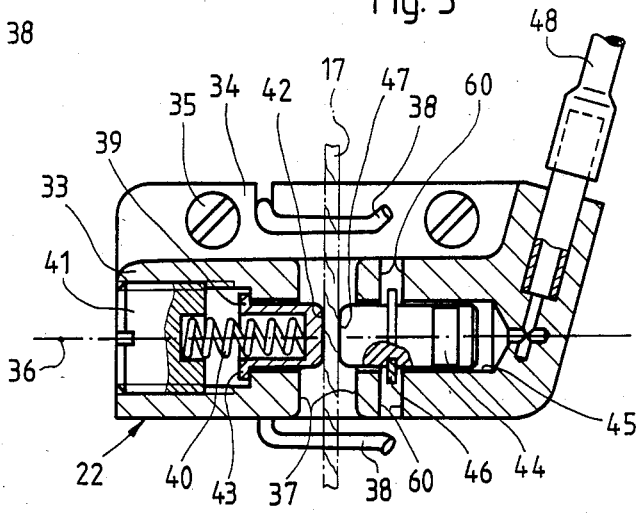

METHOD AND APPARATUS FOR DRAWING A NEEDLE THREAD THROUGH A WORKPIECE

FIELD OF THE INVENTION

The invention relates to a method for drawing the free end of a needle thread from the upper workpiece surface to the lower workpiece surface at the first stitch of a seam to be produced by a sewing machine having a reciprocating needle carrying the needle thread drawn from a spool by means of a thread take-up lever and having a work presser lowerable on and liftable from the workpiece and having a rotatingly drivable hook, which seizes and withdraws the needle thread loop for stitch formation. Moreover, the invention relates to a device for carrying out the method.

BACKGROUND OF THE INVENTION

Visible seams, commencing within the workpiece, should be provided with needle thread ends drawn towards the lower workpiece surface, wherein a needle thread forms the upper thread of the seam. This is no problem if the thread end of the needle thread is positioned in such a way that it is not clamped between the presser foot and the workpiece when the work presser is lowered onto the workpiece. In case that the latter nevertheless occurs, then the thread end will not be pulled through with the result that the seam becomes unsightly.

In order to assure the pulling through of the thread end through the workpiece thread pulling devices, so-called thread wipers have become known, at which a hook is movable in an angle with respect to the path of the needle and in the upper position of the latter. Thus, by the hook the thread end hanging down from the needle will be gripped at the descent movement of the needle and above the workpiece and then brought into a position above the presser foot, so that the thread end cannot be clampingly caught (DE-PS No. 25 26 694 corresponding to U.S. Patent Application Ser. No. 494,519). Such thread pulling devices are exposed to wear as they operate at a high operating frequency and almost without any lubrication. The manufacturing effort is considerable.

Moreover, blow devices are known appropriate to blow the thread end of the needle thread into a position, in which the thread end cannot be clamped between the presser foot and the workpiece.

These known devices are not applicable, if the workpiece to be processed is very thick. This applies for example to thick leather, heavy tent materials, heavy upholstery materials, upholstery mats and similar materials. In this case no sufficient clearance is available between the needle and the presser foot, so that the pulling devices cannot be used for space reasons, whereas blowing devices do not achieve an action. In the case that a thread pulling device is not applicable for space reasons, the operator must especially take care of the end of the needle thread while putting in a workpiece to be sewn, so that the end of the needle thread will not get clamped at lowering of the presser foot, respectively the presser feet, which, on the other hand, is time consuming. From German patent specification No. 276 162 it is known to prevent that the end of the needle thread released by a thread cutting operation will be pulled out of the needle due to the descending thread take-up lever. For this purpose the needle thread will be so clamped between the thread take-up lever and the eye of the needle by means of a special clamp and about simultaneously with the thread cutting operation that the thread take-up lever can only pull additional thread off the spool at its upward movement, without, however, pulling the free thread end out of the eye of the needle. In order to be no longer restricted to employ double-grooved needles, it is proposed in the German patent specification No. 276,162 to open the needle thread clamp temporarily during the penetration of the needle for the formation of the initial stitch of a stitch group following a thread cutting operation. After the looptaker has entered the needle thread loop, the needle thread clamp will be actuated again.

From German Gebrauchsmuster No. 66 03 307 a controlled thread clamp is known for the needle thread of a stitch group sewing machine, which is brought to a standstill automatically at the end of a work cycle, wherein the work clamp will be lifted, the threads will be cut off and the needle bar will be stopped shortly after its upper dead center. With this controlled thread clamp arranged on the needle bar only the threading-off of the needle thread out of the eye of the needle can be prevented by clamping the needle thread.

Moreover, it has become known from German patent specification No. 28 15 297 to modify this thread clamp, so that also an optimal length control of the thread end hanging out of the eye of the needle prior to sewing of a seam is rendered possible.

Also from German patent specification No. 1 141 165 a sewing machine with a thread clamp for clamping the thread end during the initial stitches is known, by which a threading-off of the thread out of the needle should be prevented.

SUMMARY OF THE INVENTION

It is an object of the invention to provide a method and a device for drawing the free end of a needle thread from the upper workpiece surface to the lower workpiece surface, which method and which device avoid the clamping of the needle thread between the presser foot and the workpiece in an automatic manner.

The essential feature of the invention is represented by the fact that during the formation of the first stitch and in particular about at that instant when the needle thread loop is seized by the hook beak, a withdrawal, respectively pull-off of needle thread from the thread supply will be stopped, so that the required length of thread for widening the needle thread loop as the hook beak rotates is taken away from the needle thread end which is occasionally clamped between the presser foot and the workpiece. Subsequently, the clamping of the needle thread will be discontinued, i.e. the clamp is thus only actuated for a short period of time during the initial stitch formation. The length of the thread end can be optimally chosen, so that a threading of the needle thread out of the eye of the needle will be prevented. In this manner according to the invention for drawing the the thread end of the needle thread to the lower workpiece surface, attentiveness of the operator, the thickness of the workpiece, the type of the hook and the distances of subsequent seams do not have any influence on the reliability with which the thread end will be drawn through the workpiece.

Thread clamps applicable for carrying out the inventive method are known.

With none of the aforementioned known thread clamps is it possible to achieve the effects according to the invention.

The thread clamp according to the invention renders possible in an especially advantageous manner the performance of the method according to the invention.

By the further modification according to which the work presser is provided with a work presser drive, the pressure force of which being variable, it is rendered possible to facilitate the pulling of the thread end towards the underside of the workpiece. This is then of special meaning, if especially thin easily tearing threads or especially thick threads are employed. According to the further development of the invention the pressure force, which which the presser foot presses the workpiece onto the throat plate, will be rendered while the thread end is pulled through. In order to accomplish this the work presser drive is formed as a pneumatically operable piston-cylinder-drive, which is pre-stressed by means of a compression spring, and the work presser drive is formed as a double acting pneumatically operable piston-cylinder-drive.

Further advantages and features of the invention will become apparent from the ensuing description of a preferred embodiment taken in conjunction with the drawings.

BRIEF DESCRIPTION OF THE DRAWINGS

FIG. 1 is a front view of a sewing machine according to the invention;

FIG. 2 is a side elevation of a thread clamp mounted to the sewing head according to the arrow II in FIG. 1;

FIG. 3 is a broken up illustration of the thread clamp according to the arrow III in FIG. 2, on an enlarged scale;

DESCRIPTION OF A PREFERRED EMBODIMENT

Figure 6:
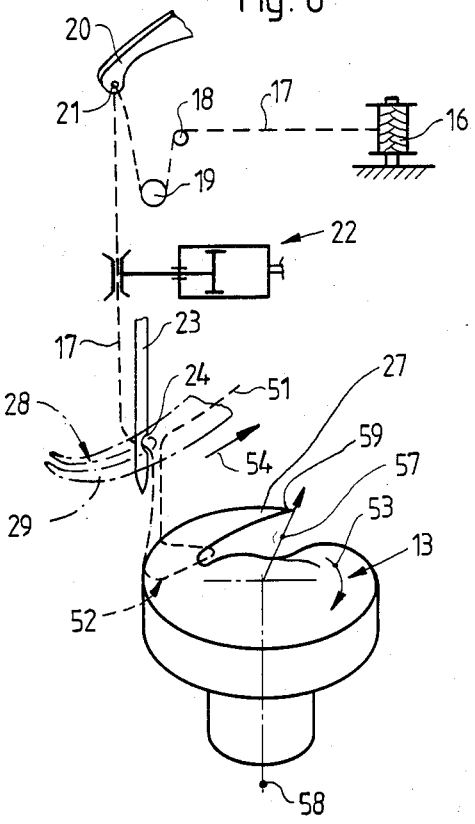
FIG. 6 is a diagrammatic representation of the ascending needle, when the hook beak has seized the needle thread loop.
Figure 4:
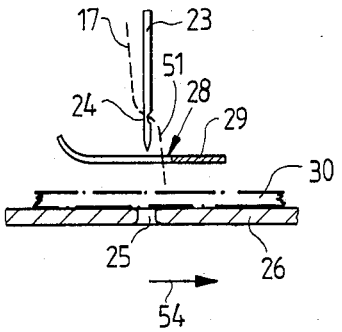
FIG. 4 is a diagrammatic representation of a needle thread carrying needle prior to the lowering of the presser foot onto a workpiece still to be sewn.

Referring to the drawings a sewing head 1 is supported on a table 2. The sewing head 1 is provided with a substantially vertically extending standard 3, from which horizontally extend an upper arm 4 and a lower base plate 5. Consequently, the sewing head 1 has the usual C-form. In the arm 4 is supported an arm shaft 6, to one end of which outside of the standard 3 a handwheel 7 is secured. The arm shaft 6 is driven by a controlled drive 8 located at the lower surface of the table 2. The drive 8 substantially consists of a motor 9 provided with a coupling- and stopping-unit and a control unit 10. The drive is transmitted from the motor 9 to the handwheel 7 by means of a V-belt drive 11.

A needle bar 12 is reciprocatingly driven in usual manner by the arm shaft 6, which needle bar 12 is supported in the front part of the arm 4. Furthermore, the arm shaft 6 drives a hook 13 with the double rate of revolutions related to the movement of the needle bar 12 by means of a rotary-drive transmission located in the standard 3 and the base plate 5. To the arm shaft 6 is coupled an encoder 14, which on the one hand transfers signals representing the rate of revolutions of the arm shaft 6 and on the other hand transfers signals representing the position of the angle of rotation to the control unit 10 via a signal-transmitting wire 15.

A spool 16 is arranged to the arm 4 carrying a thread supply, from which is pulled off a needle thread 7. This needle thread 17 is guided via a guide 18 to a thread tensioner 19 and from there through a thread eye 21 of a thread take-up lever 20. Then the needle thread 17 is substantially vertically guided downwards through a thread clamp 22 to a needle 23 carried by the needle bar 12. The needle 23 is formed with a needle eye 24, through which is guided the needle thread 17. The reciprocating needle 23 penetrates a stitch hole 25 located in a throat plate 26. The throat plate 26 is arranged above the hook 13 and about flush with the upper surface of the table 2. The hook beak 27 of the hook 13 passes the needle 23, respectively of its vertical path.

A reciprocable work presser 28 is supported to the arm 4 in parallel with the needle bar 12, the presser foot 29 of which work presser 28 presses and fixes a workpiece 30 onto the throat plate 26 during sewing.

A thread cutter 31 is mounted below the throat plate 26 for cutting the needle thread 17 and a looper thread 32 at the end of a sewing cycle. In so far, the sewing machine as illustrated in the drawings and described as yet, is generally known and commercial, and, with the exception of the thread clamp 22, it corresponds to sewing machines commonly employed by the sewing industry.

The thread clamp 22 consists of a housing 33 formed with a fastening plate 34 fastened to the arm 4 by means of screws 35 i.e., the thread clamp 22 is stationarily provided between the thread take-up lever 20 and the needle 23. The housing 33 is provided with a thread receiving slot 37, which extends transversely with respect to its longitudinal center axis 36 of the housing 33, i.e. substantially vertically and in the direction of the needle thread 17. The needle thread 17 extending from the thread lever 20 to the needle 23, can be pulled through the slot 37 and is held therein by means of thread guiding eyes 38. To one side of the thread receiving slot 37 is arranged a resilient cut-shaped thread clamping abutment 39 abutting against a pre-tensioned helical compression spring 40, which is supported by an adjusting screw 41. The adjusting screw 41 is adjustable in the direction of the longitudinal center axis of the housing 33.

By such an adjustment the pre-tension of the compression spring 40 will be altered. The needle thread 17 rests against the bottom of the thread clamping abutment 39 serving as clamping surface 42. The abutment 39 is kept in its inoperative position by a stop collar 43 as illustrated in FIG. 3 and may only be displaced against the force of the compression force 40. On the side opposite to the abutment 39 a pneumatically operable clamping piston 44 is mounted. The piston 44 is movably received in a cylinder chamber 45 which can be supplied at one side with compressed air. In an annular groove the clamping piston 44 carries a stop 46 formed as a retaining ring projecting with play into a slot 60 of the housing 33. The play is formed by a wider construction of the slot 60 with respect to the stop 46, so that the clamping piston 44 is movable to and fro between two end positions. The play is so dimensioned that also a needle thread 17 of a maximum thread size can pass the thread clamp 22 without hindrance, when the clamping piston 44 and the abutment 39 are in their inoperative positions. The clamping piston 44 projects from the cylinder 45, at which its free front surface serving as thrust surface 47 is turned to the needle thread 17. A compressed air line 48 merges into the portion of the cylinder 45 opposite to the thrust surface 47. When pressurized the clamping piston 44 is moved out of the inoperative position as illustrated in the drawings into its outer end position limited by the stop 46 and thus clamps the needle thread 17 between its thrust surface 47 and the clamping surface 49 of the abutment 39. By rotating the adjusting screw 41 the frictional force acting upon the needle thread 17 can be altered. Thus, influences resulting from different thread sizes may be compensated. Moreover, different coefficients of friction may be compensated which result on the one hand from different types of threads, respectively yarns, and, on the other hand, from different workpiece-fabrics.

A solenoid valve 49 is interconnected in the compressed air line 48, which valve is controlled by the control unit 10 via a control wire 50.

Figure 5:
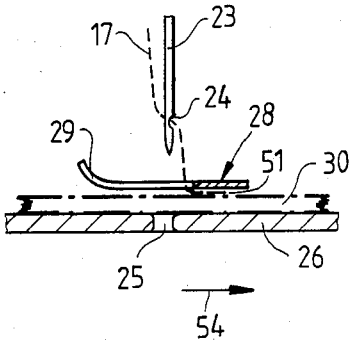
FIG. 5 is a diagrammatic representation of the needle prior to the penetration of the workpiece, at lowered presser foot.

Operation is described as follows:

At the beginning of the sewing operation in particular after a previous thread cutting operation of the thread cutter 31, a thread end 51 of the needle thread 17 hangs down from the needle eye 24 of the needle 25 through the presser foot 29 and terminates above and respectively rests on the still not yet sewn workpiece 30. Shortly before the needle 23 perforates the workpiece 30, the work presser 28 is lowered onto the workpiece 30, at which, as obvious from FIG. 5, the thread end 51 is clamped between the presser foot 29 and the workpiece 30.

Figure 7:
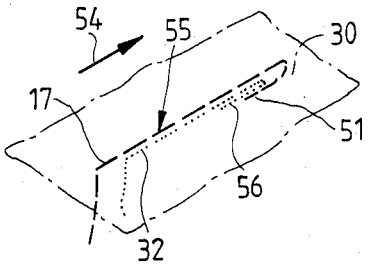
FIG. 7 shows a workpiece with a seam, at which the thread ends of the needle thread and the lower thread are positioned on the lower workpiece surface.

At the descending movement of the needle 23 through the workpiece 30 down to the lower dead center, the needle thread 17 is withdrawn. Subsequently, when the needle 23 ascends and in particular when the needle 24 is still positioned in the workpiece 30, a needle thread loop 52 is formed, which is seized and withdrawn by the hook beak 27 of the hook 13 rotating in the direction of rotation 53. If the thread end 51 is clamped between the presser foot 29 and the workpiece 30, the needle thread length necessary for forming the needle thread loop 52 is drawn off from the thread supply. In order to prevent this, at the instant when the needle thread loop 52 is seized by the hook beak 27, the clamping piston 44 is pressurized for which a corresponding actuation of the solenoid valve 49 is triggered by the control unit 10, so that the needle thread 17 is clampingly held between the thrust surface 47 of the clamping piston 44 and the clamping surface 42 of the abutment 39. At the widening of the loop 52 by the rotation of the hook beak 27 the thread end 51 clamped between the presser foot 29 and the workpiece 30 is consumed, i.e. this thread end 51 is drawn downwardly through the workpiece 30 and the stitch hole 25 and thus located in the lower position as illustrated in FIG. 7. After the thread end 51 is drawn downwardly through the workpiece 30 the thread end 51 hangs down freely without forming a loop 52. Consequently, only the thread end 51 hangs down. FIG. 7 also shows a seam 55 extending opposite to the feeding direction 54 of the workpiece 30. The thread end 51 of the needle thread 17 forming the upper thread in the seam and the initial respectively leading end 56 of the lower thread 32 are sewn into the seam at the lower surface of the workpiece 30 by the initial and next following stitches.

In FIG. 6 a radiant 57 is drafted from the axis of rotation 58 of the looptaker 13 through the outermost point 59 of the hook beak 27 leading in the direction of rotation 53. In suitable manner the thread clamp 22 is actuated at the earliest when this radiant 57 extends through the path of the needle 23, because from this instant up to an angle of rotation of 10° in the direction of rotation 53 of the hook beak 29 the point 59 of the hook beak 29 enters the needle thread loop 52. The needle thread loop 52 is opened widest when the radiant 57 is turned forward by 240° from the path of the needle 23, i.e. when the needle thread 52 begins to drop off from the hook 13. From then on no further needle thread 17 is withdrawn, i.e. the pressurizing of the clamping piston 44 can be released.

Figure 8:
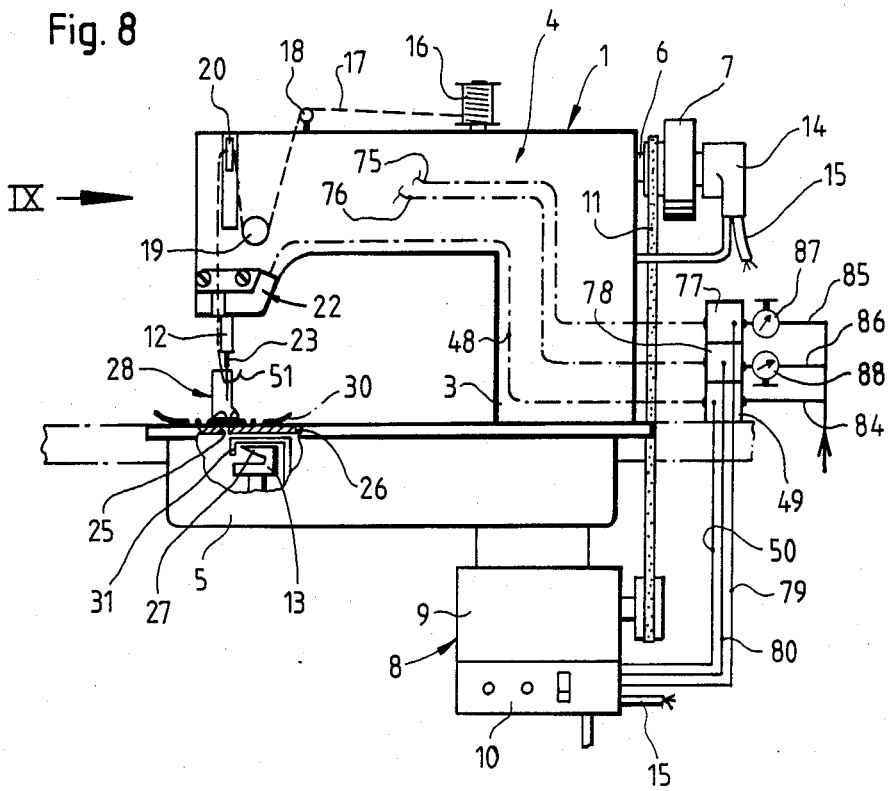
FIG. 8 shows a sewing machine in an embodiment according to the invention in a front view with an additional work pressure drive.
Figure 9:
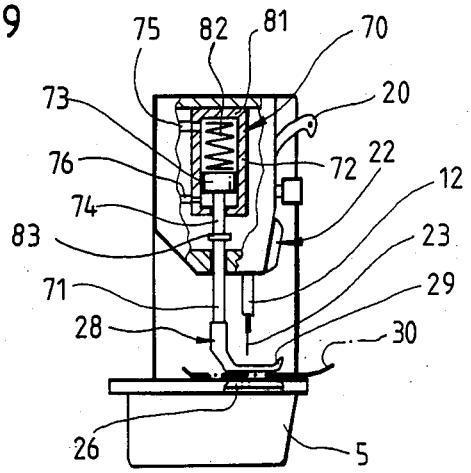
FIG. 9 is a side view of the sewing machine with the additional work pressure drive according to the arrow IX in FIG. 8.

In a modified embodiment according to FIGS. 8 and 9 a work presser drive 70 connected with a presser foot bar 71 is associated to the work presser 28. This work presser drive 70 consists of a double acting pneumatically operable piston cylinder drive in the cylinder 72 of which a piston 73 is displaceably arranged, the piston rod 74 of which is directly connected to the presser foot bar 71. The cylinder 72 and the piston 73 with the piston rod 74 are arranged flush with the presser foot bar 71. In the area of both ends of the cylinder 72 discharge two compressed air hoses 75, 76, in each of which a solenoid valve 77, 78 is arranged, which valves are individually operable via control wires 79, 80 by the control unit 10. A pre-stressed helical compression spring 82 is arranged above the piston 73 abutting against the piston 73 and the upper bottom 81 of the cylinder 72. The compression spring 82 acts on the piston 73 with a pre-determined force, so that—at depressured compressed air hoses 75, 76—the presser foot 29 will be forced downwardly onto the workpiece 30 by a total force resulting on the one hand from the force of the compressed spring 82 and the total force of weight of the work presser 28 and the piston 73 with the piston rod 74 on the other hand.

A stop 83 is situated at the piston rod 74, respectively the presser foot bar 71, which limites the stroke of the piston 73 with the piston rod 74 versus the compression spring 82 and thus also the lift stroke of the presser foot 29 from the throat plate 26.

The solenoid valves 49, 77, 78 are supplied with compressed air via the supply hoses 84, 85, 86. In both supply hoses 85, 86 for the solenoid valves 77, 78 adjustable pressure reducing valves 87, 88 can be interconnected, by means of which the pressure of the compressed air arriving via the supply hoses 85, 86 is alterable.

The modified embodiment according to FIGS. 8 and 9 operates—as far as the operation of the thread clamp 22 is concerned—identically to the embodiment according to FIGS. 1 to 7. Additionally the pressure force, by which the workpiece 30 is pressed onto the throat plate 26 by means of the presser foot 29 can be varied, i.e. is variable.

At the normal sewing operation—for example—the piston 73 is exposed to pressurized air on its upper side via the compressed hose 75 respectively the associated solenoid valve 77 and is positioned in the lower position. Shortly after the hook beak 27 has seized the needle thread loop 52 in the manner already described in order to pull down the thread end 51 to the lower side of the workpiece 30, the solenoid valve 77 is operated for a short period of time due to a corresponding control via the control wire 79 in order to depressurize the hose 75, so that the thread end 51 to be pulled to the lower side of the workpiece 30 can be comparably easily pulled down by the hook beak 27. During this time of pressure relief the presser foot 29 is pressed down only yet with the force caused by the compression spring 82 and the weight of the work presser 28 with the piston 73 and the piston rod 74. If the weight for this instant is already sufficient then the additional compression spring 82 can be omitted. The compression spring 82 can also be omitted if the piston 73 is exposed to compressed air due to an activation of the solenoid valve 77 on one side and for a short period of time exposed on the other side to compressed air due to the activation of the solenoid valve 78, so that actually both sides of the piston 73 are exposed to compressed air. In this case the piston 73 only acts with a reduced force on the work presser 28. At this kind of activation of the solenoid valve 77, 78 the pressure reducing valves 87, 88 render possible to accommodate the forces in accordance to the individual operating conditions in the different shift conditions of the solenoid valves 77, 78.

At relieved hose 75 the actuation of the piston 73 via the hose 76 and the associated solenoid valve 78 serves for lifting of the presser foot 29, wherein the displacement of the piston 73 with the piston rod 74 up to the abutment of the stop 83 against the cylinder 72 takes place. The work presser drive 70 as afore-described thus also comprises, as otherwise usual, work presser operating device. These additional measures are then especially advantageous if the needle threads 17 to be processed are very thin and therefore can tear at a low lever of clamping forces, or if the threads to be processed are very thick and thus oppose a considerable resistance to the thread pulling process. In the latter event at too high forces to be applied also the motor 9 of the sewing machine would be loaded up to its range of limitation. Depending on the area of application the threads have a diameter of up to 1.5 mm.

For both pre-described embodiments applies that the exact instant of activation of the solenoid valve 49 respectively solenoid valves 49, 77, 78 is determined by the signal of the encoder 14 representing the rotary angle of the arm shaft of the sewing machine.

What is claimed is:

1. Method for drawing a free end of a needle thread from an upper workpiece surface to a lower workpiece surface at the first stitch of a seam to be produced by a sewing machine having a reciprocable needle, which carries the needle thread drawn-off from a spool by means of a thread take-up lever, and having at least one work presser lowerable onto and liftable from said workpiece, and having a rotatingly drivable hook, the back of which seizes and withdraws a needle thread loop for stitch formation, wherein said needed thread is held tightly between said needle and said thread take-up lever, while said needle thread loop is widened by said hook beak, so that the thread end is drawn by said hook beak through said workpiece.

2. Method according to claim 1, wherein said needle thread is clamped.

3. Method according to claim 1, wherein said work presser is at least partially released while said needle thread is held tightly.

4. Method according to claim 1, wherein said needle thread is held tightly by a thread clamp stationarily provided between said thread take-up lever and said needle.

5. Method according to claim 1, wherein said needle thread is clampingly held by means of frictional forces between a clamping surface of an abutment and a thrust surface of a clamping piston, the friction force being performed to said needle thread at actuation of the clamping piston being adjustable.

6. Method according to claim 1, wherein the pressure force with which the presser foot presses the workpiece on a throat plate of the sewing machine is reduced while the thread end is pulled through the workpiece.

7. Device for drawing a free end of a needle thread from an upper workpiece surface to a lower workpiece surface at a first stitch of a seam to be produced by a sewing machine, said sewing machine having a reciprocable needle, which carries the needle thread drawn-off from a spool by means of a thread take-up lever, and having at least one work presser lowerable onto and liftable from said workpiece, and having a rotatingly drivable hook, the beak of which seizes and withdraws a needle thread loop for stitch formation, wherein a thread clamp for said needle thread is stationarily provided between said thread take-up lever and said needle and wherein control means are provided for actuating said thread clamp, only while said needle thread loop of said first stitch is being widened by said hook beak, so that the thread end is drawn by said hook beak through said workpiece.

8. Device according to claim 7, having an abutment including a clamping surface and having a clamping piston including a thrust surface, said needle thread being clampingly held by means of frictional force at actuation of said clamping piston between said clamping surface and said thrust surface, wherein said clamping frictional force clamping said needle thread is adjustable.

9. Device according to claim 8, wherein said abutment is movably abutting against a compression spring with an adjustable pre-tension, and wherein said clamping piston for clamping said needle thread is restable against a stop.

10. Device according to claim 7, wherein said work presser is provided with a work presser drive, the pressure force of which is variable.

11. Device according to claim 10, wherein said work presser drive is formed as a pneumatically operable piston-cylinder-drive, which is pre-stressed by means of a compression spring.

12. Device according to claim 10, wherein said work presser drive is formed as a double acting pneumatically operable piston-cylinder-drive.

* * * * *